US007988313B2

(12) United States Patent
Kutnyak

(10) Patent No.: US 7,988,313 B2
(45) Date of Patent: Aug. 2, 2011

(54) ILLUMINATED HEADGEAR

(76) Inventor: Mark R. Kutnyak, Big Bend, WI (US)

( * ) Notice: Subject to any disclaimer, the term of this patent is extended or adjusted under 35 U.S.C. 154(b) by 289 days.

(21) Appl. No.: 12/052,055

(22) Filed: Mar. 20, 2008

(65) Prior Publication Data

US 2009/0237917 A1 Sep. 24, 2009

(51) Int. Cl.
*F21V 21/084* (2006.01)
*A42B 1/24* (2006.01)
*G09F 3/04* (2006.01)

(52) U.S. Cl. ..... 362/106; 2/422; 40/329

(58) Field of Classification Search ..... 362/103, 362/105–107; 2/5, 171, 205, 410, 422; 40/329
See application file for complete search history.

(56) References Cited

U.S. PATENT DOCUMENTS 4,319,308 A 3/1982 Ippoliti et al.
4,559,586 A * 12/1985 Slarve ..... 362/106
5,615,940 A * 4/1997 Barry ..... 362/473
5,743,621 A 4/1998 Mantha et al.
5,871,271 A 2/1999 Chien
6,464,369 B1 * 10/2002 Vega et al. ..... 362/106
6,752,510 B1 * 6/2004 Appiah ..... 362/106
7,121,676 B1 10/2006 Kutnyak
7,128,434 B1 10/2006 Nally et al.
7,304,442 B2 * 12/2007 Colwell ..... 315/307
7,497,604 B2 * 3/2009 Kleber et al. ..... 362/506
2002/0145865 A1 * 10/2002 Gregg ..... 362/106
2002/0159250 A1 * 10/2002 Kuo et al. ..... 362/106
2004/0114350 A1 * 6/2004 Golle et al. ..... 362/84

* cited by examiner

*Primary Examiner* — Alan Cariaso
(74) *Attorney, Agent, or Firm* — Boyle Fredrickson, S.C.

(57) ABSTRACT

An illuminated headgear (10), with an energy absorbing support structure (11), operationally coupled to an outer shell (12), with illuminated graphical lighting displays, containing graphical representations that are illuminated by lights (25*a*-25*f*), the lighting displays being integrated with the outer shell instead of being supported on the supporting structure (11), and further comprising graphical support membrane (82), enabling individuals to make and apply their own unique graphical representations to light-transmissive windows (13, 14) in the generally opaque outer shell (12).

16 Claims, 4 Drawing Sheets

FIG. 1
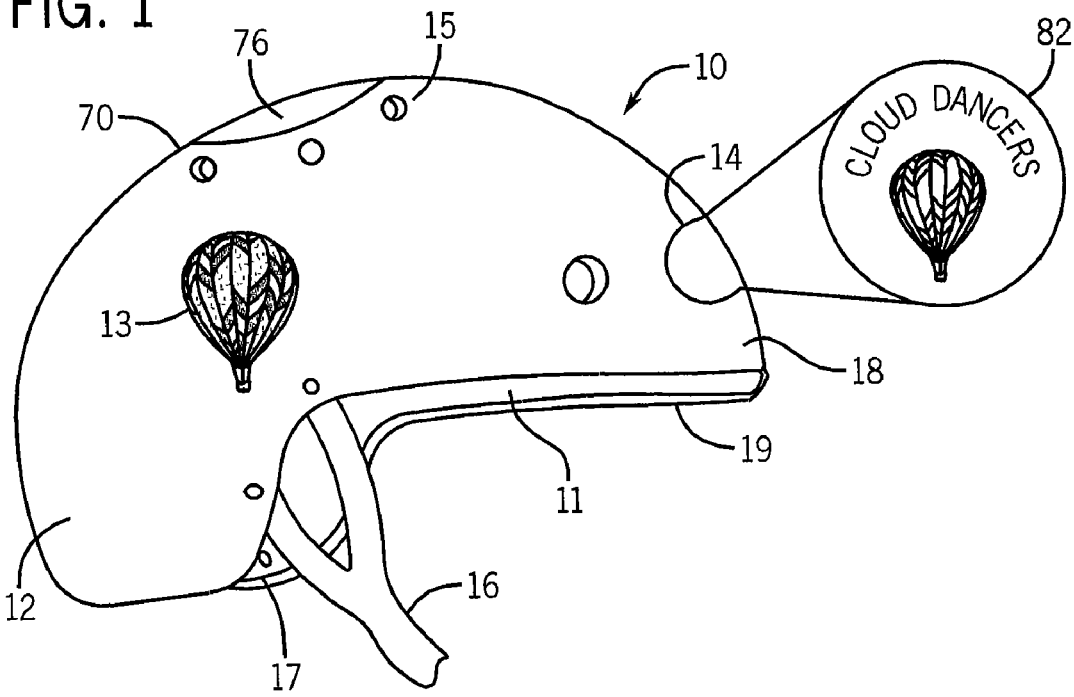
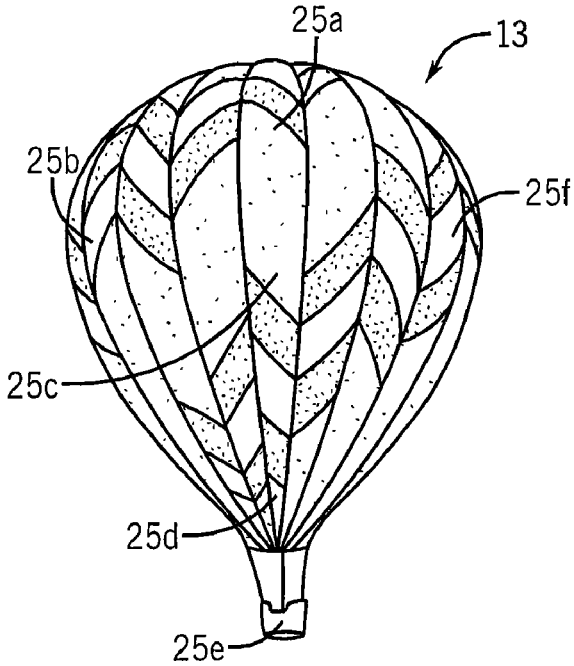
FIG. 2

FIG. 7
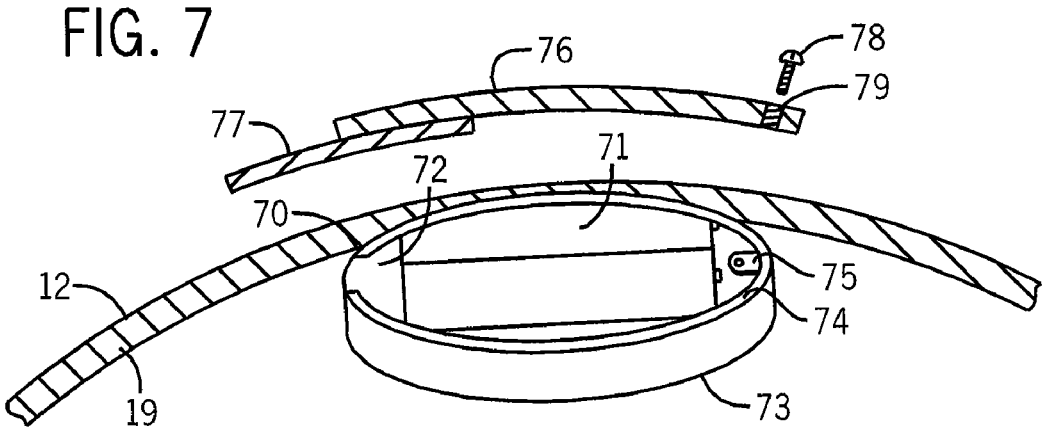
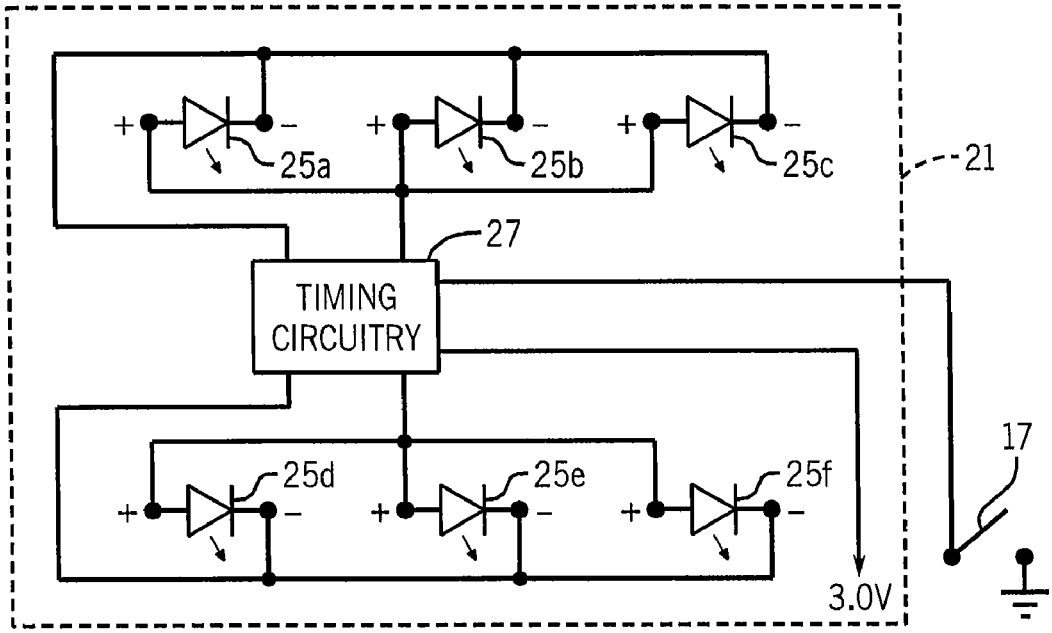
FIG. 8

ILLUMINATED HEADGEAR

TECHNICAL FIELD

The following invention relates to illuminated headgears of the type used in work-related, recreational and street use, including varieties generally worn for display purposes.

BACKGROUND ART

The use of protective headgears is growing in popularity as a larger percentage of the population make a conscious decision to use protective headgears for a variety of activities. These protective headgears are used in construction and fire-fighting, recreational activities including cycling, skate-boarding and in-line skating, as well as in motorized transportation. Many of these activities may be carried out at night or in low light conditions such that illumination would be advantageous.

There have been attempts to develop illuminated headgears in the industrial and recreational fields including use on motorized vehicles. However such headgears have been limited to use of incandescent lamps, electrolumincent light strips and recently to use of small light emitting elements as light emitting diodes (LEDs).

Ippoliti et al., U.S. Pat. No. 4,319,308, discloses a motorcycle helmet which makes use of LEDs to direct light between two thin shells of a curvilinear profile such that characters, such as alphabet letters are illuminated on the side of the helmet. The light sources are located in the bottom of the helmet to direct light upward and generally parallel to the thin shells, with light being reflected between the shells due to the curvilinear profile of the shells.

Mantha et al., U.S. Pat. No. 5,743,621, shows a helmet with illuminated translucent lenses in the front and back of the helmet.

Vega et al., U.S. Pat. No. 6,464,369, describes a helmet in which a channel is molded into the outer shell. A light source is then mounted into this outer shell channel and secured with a translucent lens.

Numerous other illuminated headgears have made use of the helmets protective core to embed or place the LEDs into or onto, distributing the light produced by these LED's through various windows placed in the helmets protective shell. However, there is the distinct danger of these LEDs penetrating the inner protective core, causing injury to the user during an impact.

Chien, U.S. Pat. No. 5,871,271, shows a cycling helmet with hard shell outer layer and a protective shock absorbing layer in which LEDs in star shapes and other shapes are proposed to be mounted on circuit boards that fit within recesses in the helmets core. In one embodiment, the LEDs are placed inside enclosures with opaque and translucent portions to form illuminated star shapes. These shapes are quite small and intended to impart a shape to an individual LED element.

Kutnyak, U.S. Pat. No. 7,121,676, shows how illuminated light panels are incorporated within shallow cavities of the headgears inner core. When energized, these illuminated light panels show graphical images through sections of the outer shell.

Nally et al., U.S. Pat. No. 7,128,434, describes an illuminated helmet in which conventional single element LEDs are embedded in cavities within the inner protective core. When these LEDs are energized by a motion activated mechanism, they illuminate small portions of the outer shell containing graphics, in relationship with the angle of light emitted by the conventional single element LEDs.

Still, other prior patents show various types of illuminated headgears. Although each type of illumination has their advantages and disadvantages, they are for the most part non-cost effective, difficult to produce and not very eye-appealing to the consumer.

Another technical problem in providing illuminated headgears is retaining the strength of the helmet to impacts. Thus, the lighting assemblies should not result in a weakening of the inner or exterior structures of the headgear or a substantial lessening of the headgear's ability to absorb and distribute energy due to an impact.

SUMMARY OF THE INVENTION

The technical problem that was solved by the invention was how to improve on the integrity and commercial appeal of illuminated headgears while providing a commercially practicable product for manufacture.

In the prior art, multi-element graphical lighting displays were disposed in cavities in the energy-absorbing support structure or core of the headgear.

The invention relates to a headgear of a previously known type comprising an outer shell, an energy absorbing support structure operationally coupled to said shell, an electronic lighting display unit supported by a substrate, a light-transmissive window disposed over the lighting display so as to permit viewing of the lights in the lighting display and any graphical representation that is disposed on at least one of, said light-transmissive window, said lighting display unit, and the substrate of said lighting display unit, wherein said graphical representation would be illuminated by said lights to be observed externally through said window.

The invention relates to an improvement comprises the outer shell including an opaque portion over most of its extent and at least one window portion of light-transmissive material integrated with the outer shell, in some embodiments, such that the outer shell is not less impact-resistant in the window portion than in the opaque portion of outer shell; and with the lighting display unit being mounted underneath a top surface of the window so as to be visible through the window but not through the opaque portion of the shell.

A more specific object of the present invention is to utilize individual packaged lighting displays.

The invention provides several variations for accomplishing the necessary level of integration with the impact-resistant outer shell of the headgear.

The invention also allows a user to add illuminated graphics of a favorite image, team, logo, cause or event.

While the invention is disclosed in the content of a headgear for recreational users, the headgear of the present invention may be adopted for other uses not described herein.

Also disclosed are the advantageous features in construction to achieve the above objects. These and other objects and advantages of the invention will be apparent from the description that follows and from the drawings, which are incorporated herein. And which illustrate the preferred embodiments of the invention. It should be understood that the invention is not limited to such embodiments, but is instead defined by the claims which follow the description.

BRIEF DESCRIPTION OF THE DRAWINGS

FIG. 1 is a perspective view of a helmet embodying the present invention, with a detail of a graphical support membrane with graphical representation;

FIG. 2 is an enlarged detail view of an illuminated graphical light display seen in FIG. 1;

FIG. 7 is a top perspective view of a portion of the helmet that includes a power supply and its components; and FIG. 8 is an electrical schematic diagram of one of the individual packaged multi-element light displays.

DETAILED DESCRIPTION OF THE PREFERRED EMBODIMENTS

Figure 3:
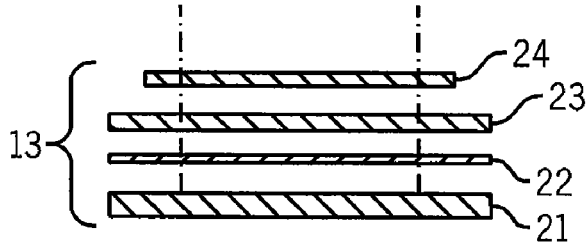
FIG. 3 is an exploded sectional view of the individual layers of an illuminated graphical light display.

FIGS. 1-3 illustrate an illuminated headgear 10 of the present invention capable of producing the desired visual effects using illuminated graphics. The illuminated headgear 10 has an outer shell 12, which has a general concave elliptical shape to fit a human head, with a corresponding outside surface 18 and inside surface 19. The illuminated headgear may use any one of several types of energy absorbing support structures 11 including, but not limited to, an impact-absorbing structural polymeric foam or similar material core, an air bladder system, rubber foam padding, webbing or other energy-absorbing material or a combination of these may be used to absorb the energy of an impact to the helmet while acting as a support structure for an outer shell 12. The headgear 10 also includes any necessary straps 16, additional padding or other devices known in the art may be used to properly secure the illuminated headgear to the head of the user. Additionally the illuminated headgear typically includes a plurality of molded-in ventilation slots or holes 15 to aid in the ventilation process.

The shell 12 may contain one or more graphical lighting displays provided by graphic lighting display units 13 or by non-graphic lighting display units to which a graphic supporting light-transmissive, preferably transparent, membrane 82 can be attached over a light-transmissive preferably transparent, window 14. This allows an individual user the opportunity to make and apply a graphic on the transparent support membrane 82. The graphical lighting display unit 13 is seen in more detail in FIG. 2, where a graphic display in the form of hot air balloon is illuminated by a lighting display unit 13 containing lighting elements, such as LEDs 25*a*-25*f*. The lighting elements are small scale examples of electronic lights that can be mounted on a substrate with other circuitry and provide brightly colored or white lights. Generally, other lighting display units would be positioned around the outside of the headgear, on opposite sides of the headgear and in the front and back, but one side and the front is illustrated here with the other lighting displays being similarly constructed.

As seen in FIG. 3, the illuminated graphical lighting display 13 includes a graphical image 22 that is applied to a substrate 21, and encapsulated in a thin layer of clear material 23, such as an epoxy-based or clear plastic material, over the assembly forming a solid illuminated graphical light display. Additionally, the graphic image may be applied between two layers of encapsulation material or the graphic image may be applied to the top of the encapsulation material 23 as layer 24, giving depth to the graphic image. The lighting display unit 13 has a much greater width dimension at the base than a height dimension, to provide a wide angle of view with a plurality of lights 25*a*-25*f*. The unit also contains its own timing circuitry 27 (FIG. 8), enabling the lighting elements contained within to flash in a timed mode of operation. This design also allows the low profiled illuminated graphical light display to have a slightly curved profile to fit flush with the inside or outside curvature of the headgear shell 12.

Generally, the hard outer plastic shells 12 used in helmets use a color additive to the molded, thermoformed or extruded plastic material to produce an opaque shell having a solid through color, or the shell can made of a colored, opaque composite material. For purposes of the shell, the term color shall include black and white as these will also produce an opaque shell. In contrast thereto, the windows of the present invention are made of a material that is light-transmissive with at most a light tint or no color, and having fully transparent, translucent or milky properties. Preferably the material is also impact-resistant when integrated with the shell 12.

The inside, outside or both areas of the outer shell 12, can be either painted or anodized, providing an opaque area on the shell buy using a stencil or other various techniques, leaving only light-transmissive windows 13-14 in a desired graphical shape that is preserved within the opaque area as seen in FIG. 1.

Figure 4:
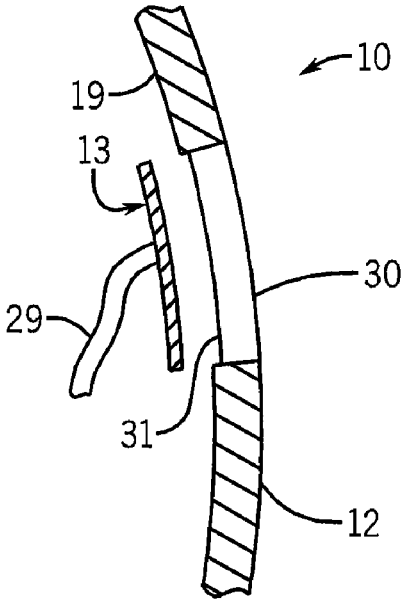
FIGS. 4 and 5 are detail sectional views of a portion of the helmet the illuminated graphical light display according to a first embodiment of the invention.

FIG. 4 shows a first variation of the present invention where the shell has been made opaque except in certain small window regions 30. A shallow cavity 31, corresponding to the outer dimensions of the illuminated graphical light display 13, is formed within the inside surface 19 of shell 12 either during the molding-thermoforming process or the cavity can be hollowed out by machining operations on the shell 12. The graphic lighting display 13 is made part of shell 12 by securing it within the cavity 31, by using hot or cold adhering techniques, including heat, ultrasound or chemical welding processes.

Figure 5:
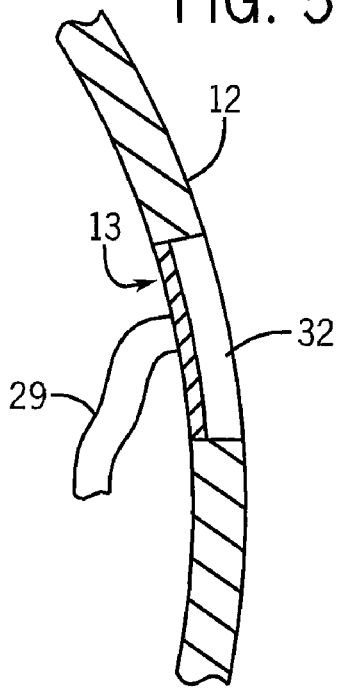

FIG. 5 illustrates another variation of the present invention in which the illuminated graphical light displays are made an integral part of shell 12, by using clear shell material and 3D-molding or thermoforming techniques so that lighting units 13, 14, which include light-transmissive window material 32 are molded within the shell 12 to form an integrated solid unit. Using stenciling techniques, the remaining inside, outside or both surfaces of shell 12 are then painted or anodized providing an opaque appearance and preserving observation windows within the shells surface corresponding to the shape of the illuminated graphical light displays.

Figure 6A:
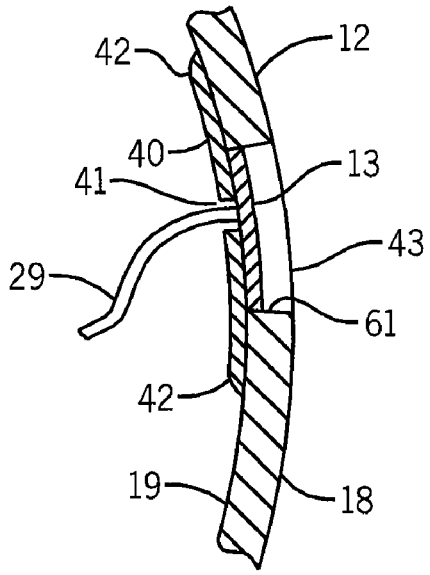
FIGS. 6*a*, 6*b* and 6*c* show variations within the scope of the present invention.

In another variation seen in FIG. 6*a*, apertures of specified shapes can be molded in or machined into shell 12, corresponding to the shape of the illuminated graphical light displays 13 and 14 seen in FIG. 1. As exemplified by this process, an illuminated graphical light display 13 is mounted on the leading face of the back lighting display support 40 shown in FIG. 6*a*, with an open electrical connection aperture 41, to allow threading of the electrical leads 29 therethrough. The back lighting display support 40 is a low-profiled durable and stiff section of plastic material such as polycarbonate or similar material having a curved, convex profile with large flange areas 42 corresponding to the curvature of the inside surface 19 of shell 12, with a surface area generally twice that of a shaped illuminated graphic light display 13. With this assembly, the illuminated graphical light display is inserted first into an appropriately shaped through cavity 61 in the shell 12, with the flange portion 42, of the back light display support 40 resting upon the inside surface 19, of shell 12. This assembly is glued or welded into place. A clear filling and sealing material, such as a clear polymer mixture, epoxy based or plastic material 43 is filled into the cavity 61 to provide a window over the illuminated graphical light display 13 positioned in the cavity 61 and allowed to harden. This seals the illuminated graphical light display 13 into the shell 12 making it one complete unit, creating an observation window, and allowing the illuminated graphics to be visible to the outside surface of shell 12. With this embodiment, the shell 12 may be made of composite materials, which generally have color, and therefore are not light-transmissive.

Figure 6B:
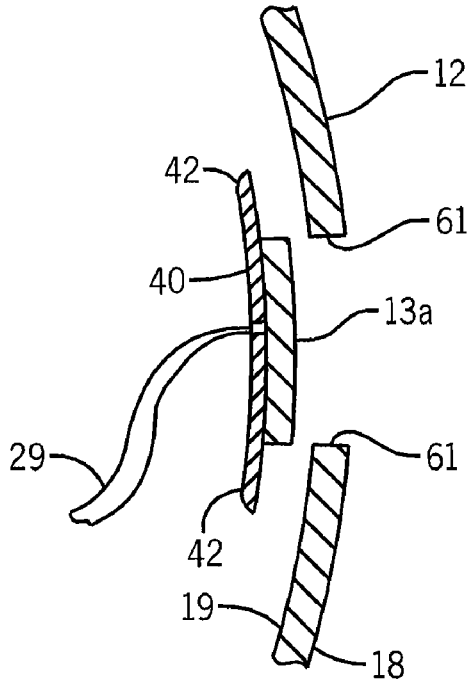

As seen in FIG. 6*b* in another variation, one can use an illuminated graphical light display 13*a* which has a height dimension equal to the thickness of shell 12. A specifically-shaped open cavity 61 is molded or machined into shell 12. An illuminated graphical light display 13 is inserted into the cavity 61 and attached to a back light display support 40, with flange portions 42 resting on the inside surface 19 of shell 12. This assembly is glued or welded into place. This embodiment allows the illuminated graphical light display to be flush with shell 12, providing a smooth outer surface.

Figure 6C:
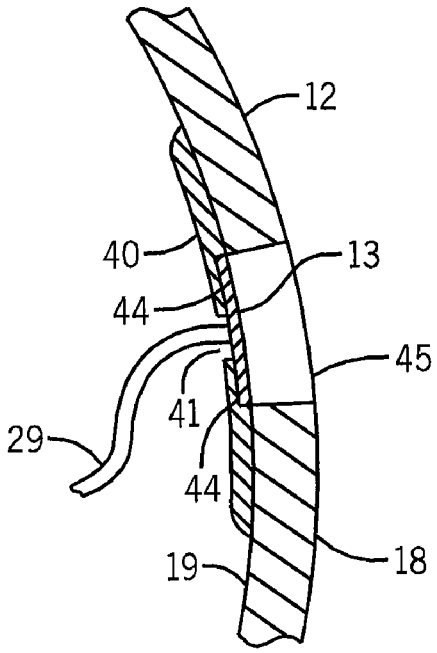

However, it is not necessary to mold or machine an open aperture into the shell 12, as seen in another variation in FIG. 6*c*. A shell material can be used that is light-transmissive. A version of the back lighting display support 40 having an impression 44 in a leading face surface to create a cavity to receive the illuminated graphical light display 13. The illuminated graphical lighting display unit 13 is secured directly to the inside surface 19 of shell 12, due to their curvilinear shape and low profile, using any of the previously mentioned gluing techniques. A solid window 45 of light-transmissive material is formed in, and completely fills the cavity 61 according to one of the methods described above, so that the lighting display unit 13 is securely mounted underneath the window 45 in an integrated manner.

Additionally, through this innovative embodiment and appropriate headgear designed for this application by using circular or other appropriately shaped non-graphic, clear, illuminated light displays, an individual is able to make and apply custom designs, creating their own unique graphics, images or logos. This allows the purchaser of the illuminated headgear to apply their own graphical details over the illuminated observation windows of shell 12 seen in FIG. 1. To aid this construction, a clear graphical support membrane 82 having the appropriate adherent properties and capable of accepting graphical representations may be disposed over the windows of the shell 12. A clear static laminate plastic sheeting or similar material may be used for the membrane 82 to allow a purchaser to produce their own specialized graphics on this material, to apply it over any observation window in shell 12, and to remove it due to the adhesive properties of the static laminate sheeting. The membrane may be light-transmissive, such that a design can be applied by using decals, pens, paint, markers both permeate and dry erasable varieties or one can make their own stencil, applying their own image and color scheme to personal preference. One can also make or purchase and apply their own permanent decals directly to the observation windows of the headgear 12.

Accordingly, as seen in FIG. 1, the illuminated graphical light displays 13 are made part of shell 12, containing their own observation window. As exemplified by FIGS. 1, 2, 3 and 8, said illuminated graphical light display 13, contains traces and timing circuitry 27 for one or more light sources 25*a*-25*f*, which are mounted to substrate 21, of a predetermined shape. A similarly shaped graphical image 22, is then applied to the substrate 21, and encapsulated in a thin layer of clear material, such as an epoxy-based or clear plastic material 23, over the assembly forming a solid illuminated graphical light display. Additionally, the graphic image may be applied between two layers of encapsulation material or the graphic image 22, may be applied to the top of the encapsulation material 24 of light display 13, giving the graphical image depth. The illuminated graphic light display has a much greater width dimension at the base than a height dimension, to provide a wide angle of view with a plurality of light sources containing its own timing circuitry means, enabling the lighting elements contained within to flash in a timed mode of operation. This design allows the low profiled illuminated graphical light display which has slightly curved profile to fit the inside or outside curvature of a headgears shell, producing a sealed unit, imparting rigidity to the light display so when they are incorporated with shell 12, they will withstand impacts to the headgear without collapsing under the forces applied during testing standards.

Referring to FIG. 8, when energized the individual light sources 25*a*-25*f* emit radiant light in all possible directions from the substrate 21, to which they are mounted on, allowing maximum viewing angle and light dispersion. Also, the light sources contained within the illuminated graphical light display turn on and off to flash, twinkle or strobe in a timed mode of operation. Additionally, the illuminated graphical light displays contain one or more light sources of one or more color combinations, complementing the graphical image when the light sources are illuminated.

Referring to FIGS. 1 and 7, an open round aperture 70 is molded or machined into to the top upper crown of shell 12. A battery door 76 is sized to fit within the inside circumference of open aperture 70, and contains a small frontal rectangular extension 77, which is shaped to fit within the open ridge section 72 of battery door support ridge 74, which has an inside and outside circumference smaller and larger than aperture 70. Battery door ridge 74 is aligned with open aperture 70 from the inside surface 19 of shell 12, and is glued or welded into place, forming a C-shaped inside ridge 74 within the aperture 70, with the battery door 76 resting on and secured to the ridge 74. The energy source or power supply 71 is disposed within the small battery container 73, sized to accept the power supply and is secured to the underside surface of battery door ridge 74, from the inside surface 19 of shell 12, by gluing or welding. Battery door 76 is placed in open aperture 70, in the forward position. This places the rectangular extension 77 into the open ridge section 72, of ridge 74 forcing battery door 76, to a closed position by applying downward pressure to the back portion of door 76, causing door 76 to be stopped and supported by ridge 74. Battery door 76, is secured to ridge 74 and shell 12, by retaining screw 78, through opening 79, and threaded boss 75, located on the back of ridge 74. A suitable alternative placement for power supply 71 and container 73 would be within a shallow cavity formed within the outer surface of energy absorbing support structure 11, which would be in alignment with aperture 70 in shell 12.

A switch 17, for example, a subminiature toggle or push type switch identified in FIG. 1 is secured to the inside ridge of shell 12 for the on-off operation of the illuminated headgear. Switch 17 is connected in series with power supply 71, containing three (3) AAA batteries connected in series parallel for a total available voltage of 3.0 volts. Switch 17 is connected in a power supply circuit with the traces of each illuminated graphical light display 13-14 as seen in FIG. 8. Besides using switch 17, one could easily incorporate the use of a number of appropriately designed switching alternatives, such as a pressure sensitive switch to activate when the headgear is worn, or a motion activating switch, energizing the illuminated graphical light displays upon movement of the headgear, including photo sensitive, accelerometer and inertia type switching means to provide power from the power source 71 to the illuminated graphical light displays 13 and 14.

As seen in FIG. 1, shell 12, is operationally coupled to an energy absorbing support structure 11, designed to fit the inside surface 19, of shell 12, as well as the shape of a human head. By use of in shell molding techniques, adhesives, Velcro™, rivets or other method necessary to secure a particular type or style of energy absorbing support structure appropriate for the particular type of design, style or functional relationship with shell 12.

As one can easily envision, there are a multitude of varying color combinations and shapes, sizes, dimensions and locations of illuminated graphical light displays and accompanying observation windows that can be used. These can range from animate and inanimate objects, company logos to alphabetic characters, numerals and the like. The invention can utilize microcontroller circuitry with the appropriate programming, including various oscillating circuitry such as MOS/CMOS integrated circuits, TTL/LS integrated circuits, linear integrated circuits or a host of similar circuitry and their accompanying components to produce an array of timed output voltage signals to energize the light sources along with the appropriate lighting elements.

The illuminated headgears described herein may be used for, but are not limited to use in, sports and recreational activities.

The intent of the present invention is to reduce the number of components used in the manufacturing process in addition to producing an illuminated, pleasing and attention-getting effect to the eye of the individuals observing the illuminated headgear.

It is also an object of the present invention to instill the visual perception of activity of the user, there by alerting the observer of the headgear to the user's presence while producing an attractive headgear that individuals will enjoy and wish to use and in which the graphics can be designed and applied by the user.

The headgear also has an aerodynamic shape with the light displays disposed so as not to interfere with the function and operation of the headgear. This makes the headgear look like an ordinary type of headgear, when the light sources are not illuminated.

This has been a description of the preferred embodiments and best mode of carrying out the invention, but it will be apparent to those with skill in the art to which the invention pertains that various modifications may be made to these specific embodiments without departing from the spirit of the present invention, and that such modifications are intended to be encompassed by the following claims.

I claim:

1. A headgear comprising an outer shell, an energy absorbing support structure operationally coupled to said shell, an electronic lighting display unit supported by a substrate, a light-transmissive window disposed over the lighting display unit so as to permit viewing of the lighting display unit and any graphical representation that is disposed on at least one of, said light-transmissive window, said lighting display unit, and the substrate of said lighting display unit, wherein said graphical representation is illuminated by said lighting display unit to be observed externally of the headgear; and wherein an improvement comprises:

said outer shell including an opaque portion over most of an extent of said outer shell and the outer shell having at least one window of light-transmissive material integrated with the outer shell;

said lighting display unit being mounted underneath a top surface of the window so as to be visible through the window but not through the opaque portion of the shell; and wherein the lighting display unit is disposed in a shallow cavity in the shell having dimensions corresponding to the outer dimensions of the lighting display unit for a close fit such that the window is flush with an outer surface of the shell and at least one of the window and the lighting display unit is flush with an inwardly facing surface of the shell, the window and the lighting display unit being supported by the shell and not on the energy absorbing support structure.

2. The headgear of claim 1, wherein the lighting display unit includes the window as a portion, the lighting display unit filling a cavity in the outer shell and is the lighting display unit is flush with both the inwardly facing surface and the outer surface of the outer shell to provide a window that is integrated with the outer shell.

3. The headgear of claim 2, wherein the lighting display unit has a non-circular irregular outer boundary and wherein the cavity in the outer shell has a corresponding non-circular outer boundary, so as to provide a tight fit for the lighting display unit in the cavity in the shell.

4. The headgear of claim 1, wherein the lighting display unit is disposed in a cavity formed behind the light-transmissive window.

5. The headgear of claim 1, wherein the outer shell is formed around the lighting display unit by a molding process.

6. The headgear of claim 1, wherein any area between an outside boundary of the graphical representation that is lighted by the lighting display unit and an inside boundary of the cavity, is colored with a same opaque color as the outer shell of the helmet to provide an appearance of integration between the lighted graphical representation and the outer shell of the helmet.

7. The headgear of claim 1, wherein the lighting display unit is mounted behind the cavity and wherein the body of light-transmissive material fills the cavity.

8. The headgear of claim 1, wherein each lighting display unit has a much greater width dimension at a base than a height dimension to provide a wide angle of view of the lighting display unit.

9. The headgear of claim 1, wherein the lighting display unit is curved slightly along a profile corresponding to the shape of an inner profile of said shell.

10. The headgear of claim 1, further comprising a battery source of power including switching means to energize said lighting display unit.

11. The headgear of claim 1, wherein the outer shell containing said light display unit is made of a material having a color, including black or white, and is opaque.

12. The headgear of claim 1, wherein the headgear has an aerodynamic shape, with the lighting display units disposed so as to not interfere with the operation and function of the headgear.

13. The headgear of claim 1, wherein the outer shell is not less impact-resistant in the window portion than in the opaque portion of outer shell.

14. The headgear of claim 1, wherein the outer shell has a plurality of windows of light-transmissive material integrated with the outer shell and disposed over respective lighting display units.

15. A headgear comprising an outer shell, an energy absorbing support structure operationally coupled to said shell, an electronic lighting display unit supported by a substrate, a light-transmissive window disposed over the lighting display unit so as to permit viewing of the lighting display unit and any graphical representation that is disposed on at least one of, said light-transmissive window, said lighting display unit, and the substrate of said lighting display unit, wherein said graphical representation is illuminated by said lighting display unit to be observed externally of the headgear; and wherein an improvement comprises:

said outer shell including an opaque portion over most of an extent of said outer shell and the outer shell having at least one window of light-transmissive material integrated with the outer shell;

said lighting display unit being mounted underneath a top surface of the window so as to be visible through the window but not through the opaque portion of the shell; and further comprising a light-transmissive graphical support membrane having adhesive properties over at least a portion of an outer surface thereof and thereby being adapted to accept user-selected graphic representations, for attachment over the window to provide a user-selected graphical display.

16. The headgear of claim 2, 4, 5, 6, 7, 15, or 3, wherein the light-transmissive material is fully transparent.

* * * * *